US012779270B2

(12) United States Patent
Stübing et al.

(10) Patent No.: US 12,779,270 B2
(45) Date of Patent: Nov. 3, 2026

(54) JUMPING MAT ARRANGEMENT

(71) Applicants: bellicon AG, Lucerne (CH); Fraunhofer-Gesellschaft zur Förderung der angewandten Forschung e.V., Munich (DE)

(72) Inventors: Julian Stübing, Munich (DE); Günter Kopf, Kippenheim (DE)

(73) Assignee: bellicon AG, Lucerne (CH)

( * ) Notice: Subject to any disclaimer, the term of this patent is extended or adjusted under 35 U.S.C. 154(b) by 0 days.

(21) Appl. No.: 19/108,613

(22) PCT Filed: Sep. 8, 2023

(86) PCT No.: PCT/EP2023/074781
§ 371 (c)(1),
(2) Date: Mar. 4, 2025

(87) PCT Pub. No.: WO2024/052554
PCT Pub. Date: Mar. 14, 2024

(65) Prior Publication Data

US 2026/0077223 A1 Mar. 19, 2026

(30) Foreign Application Priority Data

Sep. 8, 2022 (DE) ..... 10 2022 122 870.3

(51) Int. Cl.
*A63B 5/11* (2006.01)

(52) U.S. Cl.
CPC ..... *A63B 5/11* (2013.01); *A63B 2220/833* (2013.01)

(58) Field of Classification Search
CPC ..... A63B 5/11; A63B 21/055; A63B 21/0552; A63B 2024/0025; A63B 2024/0043; A63B 71/0622; A63B 2209/10; A63B 2210/00; A63B 2210/50; A63B 2220/13; A63B 2220/72; A63B 2220/833; G01L 1/146; G01L 1/205
See application file for complete search history.

(56) References Cited

U.S. PATENT DOCUMENTS 7,572,206 B2 8/2009 Wilkins et al.
11,452,916 B1 * 9/2022 Kahn ..... A63B 24/0062
(Continued)

FOREIGN PATENT DOCUMENTS

CN 212756959 U 3/2021
DE 102015120371 B3 11/2016
(Continued)

OTHER PUBLICATIONS

Preliminary Report on Patentability for PCT/EP2023/074781, dated Mar. 1, 2025, 6 pages.
(Continued)

*Primary Examiner* — Gary D Urbiel Goldner
(74) *Attorney, Agent, or Firm* — Lippes Mathias LLP

(57) ABSTRACT

A jumping mat arrangement for a trampoline includes a sensor arrangement comprising first sensor lines and second sensor lines. The first sensor lines and the second sensor lines form crossing points, and the first sensor lines and the second sensor lines are insulated from one another at least in a region of the crossing points. A position of a user of the trampoline can be precisely resolved during use of the jumping mat arrangement.

13 Claims, 5 Drawing Sheets

(56) References Cited

U.S. PATENT DOCUMENTS

| | | | | |
|---|---|---|---|---|
| 2006/0135321 | A1* | 6/2006 | Chen | A63B 5/11 482/8 |
| 2014/0155786 | A1 | 6/2014 | Haas | |
| 2015/0321039 | A1* | 11/2015 | Howe | A63B 24/0075 482/8 |
| 2017/0361155 | A1* | 12/2017 | McGrane | A63B 24/0087 |
| 2018/0280750 | A1* | 10/2018 | Fischer | A63B 21/4035 |
| 2018/0303383 | A1 | 10/2018 | Connor | |
| 2018/0311531 | A1* | 11/2018 | Dalley | A63F 13/42 |
| 2020/0047028 | A1* | 2/2020 | Okada | A63B 24/0062 |
| 2020/0096623 | A1* | 3/2020 | Okada | G01S 7/497 |
| 2020/0271685 | A1* | 8/2020 | Varone | G01P 1/07 |
| 2022/0305319 | A1 | 9/2022 | Greenberg et al. | |
| 2022/0409942 | A1* | 12/2022 | Chen | A63B 5/11 |

FOREIGN PATENT DOCUMENTS

| | | | | |
|---|---|---|---|---|
| DE | 102021100796 | A1 | 7/2022 | |
| EP | 2505235 | A1 | 10/2012 | |
| EP | 2528234 | B1 | 7/2013 | |
| EP | 2962736 | B1 | 6/2017 | |
| EP | 2404148 | B1 | 9/2018 | |
| EP | 2934704 | B1 | 9/2020 | |
| JP | 2021037168 | A | 3/2021 | |
| WO | 2014204323 | A1 | 12/2014 | |
| WO | 2015003211 | A1 | 1/2015 | |
| WO | 2016098084 | A1 | 6/2016 | |
| WO | WO-2017081614 | A1 * | 5/2017 | A63F 13/42 |

OTHER PUBLICATIONS

Office Action for German Patent Application No. 102022122870.3, dated May 5, 2023, 8 pages.

International Search Report for PCT/EP2023/074781, dated Nov. 28, 2023, 5 pages.

Office Action for European Patent Application No. 23771805.1, dated May 19, 2026, 5 pages.

* cited by examiner

JUMPING MAT ARRANGEMENT

BACKGROUND OF THE DISCLOSURE

The invention relates to a jumping mat arrangement for a trampoline, with a jumping mat, which has an upper side and a lower side, and with a sensor arrangement for acquiring information during use of the jumping mat.

The invention is directed at any type of trampoline, e.g. fitness trampolines or garden trampolines. Trampolines of this kind have an encircling frame and a jumping mat, which is stretched within the frame by means of spring elements. The spring elements are, for example, metal spiral springs or rubber-elastic rope portions, in particular rope rings. The jumping mat is of flexible design and allows the user gentle oscillation or jumping on the upper side of the jumping mat. The encircling frame is held at a distance from the ground by legs fastened to the frame, for example.

Trampolines of this kind are known and are tried and tested. However, there was a need in the prior art to obtain additional information on the use of the trampoline.

In practice, there is a known jump counter which counts the number of jumps made. In this case, use is made of a contact sensor with a conductive metal ball which generates an electronic flank with each jump by making contact. Each flank corresponds to one jump.

EP 2 962 736 B1 discloses a trampoline with sensors, by means of which forces or accelerations acting on the jumping mat are detected. The sensors are arranged on the lower side of the legs, and therefore the trampoline stands completely on the sensors.

EP 2 934 704 B1 discloses a trampoline with acceleration sensors which are arranged in pairs around the jumping mat. The sensors define a coordinate space. It is thereby possible to determine the jumping zone of the jumping user of the trampoline.

The known sensor systems are inaccurate.

SUMMARY OF THE DISCLOSURE

The underlying object of the invention is to provide a trampoline that has a sensor arrangement and allows a higher resolution.

This object is achieved by a jumping mat arrangement having the features of patent claim 1.

According to the invention, the sensor arrangement comprises first sensor lines and second sensor lines, wherein the first sensor lines and the second sensor lines form crossing points. The first and second sensor lines preferably extend over the jumping mat. The crossing points permit a high resolution of the sensor arrangement. It is thereby possible to precisely resolve where the user is located on the jumping mat. The first and second sensor lines expediently form a matrix that covers a jumping region of the jumping mat, wherein border regions of the jumping mat can be omitted. The latter are only seldom jumped upon and, in part, are used to suspend the jumping mat on the frame of the trampoline.

The first sensor lines and the second sensor lines are insulated from one another at least in the region of the crossing points. There is therefore no electronic contact between the sensor lines in this region. The crossing points can be insulated individually. It is simpler if a plurality of crossing points are insulated by a common insulator, which can be of sheet-like, in particular layered, design, as will be explained in greater detail below.

The invention creates completely new possibilities for use. The digital image during use of the trampoline makes it possible, for example, to specify and monitor motion sequences (e.g. foot positions or jump frequencies). This allows customized training on the trampoline. There are also many different possibilities for play. Finally, the digitization also permits networking of a number of trampolines, creating possibilities for interaction.

The sensor arrangement is preferably a capacitive sensor arrangement. It is advantageous if the first sensor lines form transmission lines and the second sensor lines form reception lines or vice versa. The first and the second sensor lines are connected to an evaluation unit, which has a controller. In addition, the evaluation unit can also comprise a terminal panel for connection of the sensor lines and/or a power supply. The controller will be arranged on a circuit board, for example. The terminal panel can also be arranged on the circuit board, in which case provision is then preferably made for the controller to be connected to the terminal panel via circuit board conductors. Finally, the evaluation unit can also have an interface for an evaluation computer for the data supplied by the controller.

During a measurement process, the transmission line transmits field lines to the reception line at fixed time intervals, and these are deflected when the foot (or some other part of the body) approaches. The degree of deflection is converted proportionally by the controller and software into a distance from the medium that has approached. This contactless measurement principle is known, for example, from touchscreens or capacitive proximity sensors.

During the use of the trampoline, the jumping mat is deformed. To achieve this, the jumping mat is of flexible design. During the use of the trampoline, the first and second sensor lines are deflected together with the jumping mat. The deflection may also include a strain component. In this context, as a further development of the invention, it is proposed that the first and the second sensor lines each run in a main direction of extent, wherein they deviate sideways in alternation in the direction of the main direction of extent. Thus, the sensor lines do not run in a linear manner but deviate sideways, e.g. in a zigzag shape or in a meandering shape. Owing to the deviation, the sensor lines—and thus the entire sensor arrangement—on the one hand achieve improved flexibility. On the other hand, the sensor area is also increased. This applies especially when the sensor lines deviate in the plane of the jumping mat or a plane parallel to the jumping mat, as is considered advantageous.

The jumping mat has an upper side and a lower side. The user of the trampoline jumps or oscillates on the upper side. The upper side is therefore particularly loaded or stressed. An advantageous exemplary embodiment is characterized in that the first sensor lines and the second sensor lines run on the lower side. They are thereby protected from mechanical overloading. Such a sensor arrangement has a long life.

An advantageous embodiment of the invention is characterized in that a flexible intermediate layer is arranged between the first sensor lines and the second sensor lines. The intermediate layer is a support layer for the sensor lines, which are preferably fastened, in particular stitched, to the intermediate layer. The intermediate layer is advantageously electrically insulating. Thus, it is regarded as advantageous if the intermediate layer extends over a plurality, in particular over all, of the crossing points. The intermediate layer thus performs two tasks, namely, on the one hand, a support function and, on the other hand, an insulating function.

The fact that the sensor lines are advantageously stitched onto the intermediate layer has already been addressed above. They can also be fastened directly to the jumping mat, in particular being adhesively bonded or stitched on. However, the intermediate layer offers the advantage of a simple production method and particular protection for the sensor lines. This applies especially if the intermediate layer is arranged on the lower side of the jumping mat, as is considered advantageous.

If the sensor lines are stitched on, the sensor lines are expediently designed as conductive individual filaments, which can be stitched together. Such conductive filaments are known.

The intermediate layer is preferably of flexible design. This enables it to follow the deflection of the jumping mat.

In a preferred exemplary embodiment, the intermediate layer is of elastic design. For this purpose, the intermediate layer expediently has an elastane component. It is particularly advantageously prestressed in the direction of the jumping mat. This applies especially if the intermediate layer is firmly connected to the jumping mat (e.g. in a stitching process). However, even if the intermediate layer and the jumping mat are connected releasably, the intermediate layer can be prestressed to reduce sagging. Ideally, the intermediate layer rests flat against the jumping mat in the position of rest of the jumping mat, in which the jumping mat is not subject to a load, although, in practice, the intermediate layer will generally be at a certain distance from the jumping mat on account of its own weight. This distance is kept as small as possible to ensure that the jumping mat rests against the intermediate layer even with a slight deflection.

The fact that deviation of the sensor lines is advantageous has already been addressed above. In this context, it has proven advantageous in terms of production that the first sensor lines and the second sensor lines are stitched in a zigzag pattern onto the intermediate layer.

It is advantageous if the first sensor lines are arranged, in particular stitched on, on one side and the second sensor lines on the other side of the intermediate layer. If the sensor lines are stitched on, a nonconductive filament is expediently used as an underlying filament. This ensures that the first and the second sensor lines are insulated from one another.

The intermediate layer is preferably fastened to the jumping mat. It is thereby directly coupled to the jumping mat and moves with it while the trampoline is being used. The intermediate layer is, for example, firmly stitched to the jumping mat. They are then firmly joined. Alternatively, the jumping mat and the intermediate layer are connected releasably to one another. A hook and loop connection or a connection by means of press studs may be considered here, for example. A releasable connection has the advantage that the intermediate layer can be exchanged or retrofitted.

The intermediate layer preferably consists of a textile material but may also be formed from other technical mixed fibers.

In an advantageous embodiment, the intermediate layer is connected to the jumping mat at least in the region of the circumference of the latter. Such fastening permits accurate positioning of the intermediate layer in relation to the jumping mat. In a preferred exemplary embodiment, the intermediate layer is fastened substantially exclusively in the region of the circumference. There is then substantially no fastening provided in the actual jumping region, where in the present case "substantially" means that the intermediate layer can be connected to the jumping mat at individual points in the jumping region in order to couple the intermediate layer to the jumping mat.

With the matrix resulting from the first and the second sensor lines, large-area and, at the same time, high-resolution coverage of the jumping area is desirable. It has proven particularly advantageous that the first sensor lines and the second sensor lines are each curved in their main direction of extent. The curvature advantageously enables the jumping area to be covered if the jumping mat is of round design.

At the same time, the curvature does not necessarily have to correspond to the curvature or radius of the jumping mat. On the contrary, it is sufficient, even in the case of the sensor lines running on the outside, if these have a less pronounced curvature than the border of the jumping mat.

One advantageous embodiment is characterized in that the spacing between adjacent crossing points, when viewed in the radial direction of the jumping mat, is greater on the outside than on the inside. It is regarded as particularly advantageous if the curvature of the first and/or of the second sensor lines increases toward the border of the jumping mat. A matrix of this kind provides a larger sensor density in the main jumping region of the jumping mat in order to increase measurement accuracy there. In the region of the circumference, a jumping mat tends to be less jumped upon/loaded, and therefore a coarser sensor matrix is sufficient there.

As already mentioned at the outset, the first and the second sensor lines are connected to an evaluation unit. This means that the sensor lines advantageously converge in a terminal panel. For this purpose, it is advantageously proposed that the first sensor lines and/or the second sensor lines are routed to the evaluation unit along the circumference of the jumping mat arrangement in the border region of the jumping mat arrangement. If an intermediate layer is used, the first and/or the second sensor lines are preferably routed to the evaluation unit in the border region of the intermediate layer.

Alternatively, they are routed to the evaluation unit in the border region of the jumping mat (this being possible with or without an intermediate layer). In particular, it is regarded as advantageous if the first sensor lines are routed to the evaluation unit outside the second sensor lines, or vice versa. It is also regarded as advantageous if the first sensor lines are routed to the evaluation unit on top of the intermediate layer and the second sensor lines are arranged underneath, or vice versa. This allows an alternating method of connection, e.g. above and below respectively in the case of a two-sided terminal panel.

The terminal panel preferably has terminals for connecting the first and second sensor lines. The terminals are, for example, designed as press studs which provide a releasable connection between the controller and the sensor lines, this being regarded as advantageous. The terminals may also be designed as plug connectors, which are advantageously likewise of releasable design. The releasable connection offers the possibility of releasing the evaluation unit from the jumping mat arrangement and, for example, repairing, exchanging or retrofitting it. Alternatively, the sensor lines are connected in a fixed manner, e.g. soldered, to the terminal panel. Such a design is very compact.

When connecting the sensor lines to the terminal panel, care should be taken to ensure that the sensor lines are insulated in a region in which they may come into contact with one another on account of the movement of the jumping mat, thus ensuring as little crosstalk as possible between adjacent sensor lines. For this purpose, the sensor lines are preferably coated with silicone in order to ensure mechanical protection and to reduce crosstalk (NEXT).

It is advantageous if the evaluation unit is fastened to the jumping mat or the intermediate layer. It has proven particularly advantageous in this context to arrange the evaluation unit in the region of the circumference of the jumping mat arrangement, expediently in a border of the jumping mat extending over hooks of the jumping mat. If an intermediate layer is employed, the evaluation unit is preferably accommodated in a border situated radially to the outside of the fastening of the intermediate layer to the jumping mat.

One advantageous embodiment of the invention is characterized in that the first sensor lines each form first electrodes, and the second sensor lines each form second electrodes, in that the first electrodes and the second electrodes are insulated from one another by insulation in the region of the crossing points, and in that the first electrodes and the second electrodes, together with the insulation, each form a sensor in the region of the crossing points. Thus, each sensor is formed by a first electrode, the insulation and a second electrode. The sensor is preferably a capacitive sensor. The first and the second sensor lines advantageously form a grid of individual sensors at the crossing points. As already explained above, the crossing points can be insulated individually by the insulation. It is simpler if a plurality of crossing points are insulated by a common insulator, which can be of sheet-like, in particular layered, design.

BRIEF DESCRIPTION OF THE DRAWINGS

The invention is explained in greater detail below by means of a preferred exemplary embodiment in conjunction with the appended drawing.

In the drawing.

DETAILED DESCRIPTION OF THE PREFERRED EMBODIMENTS

Figure 1:
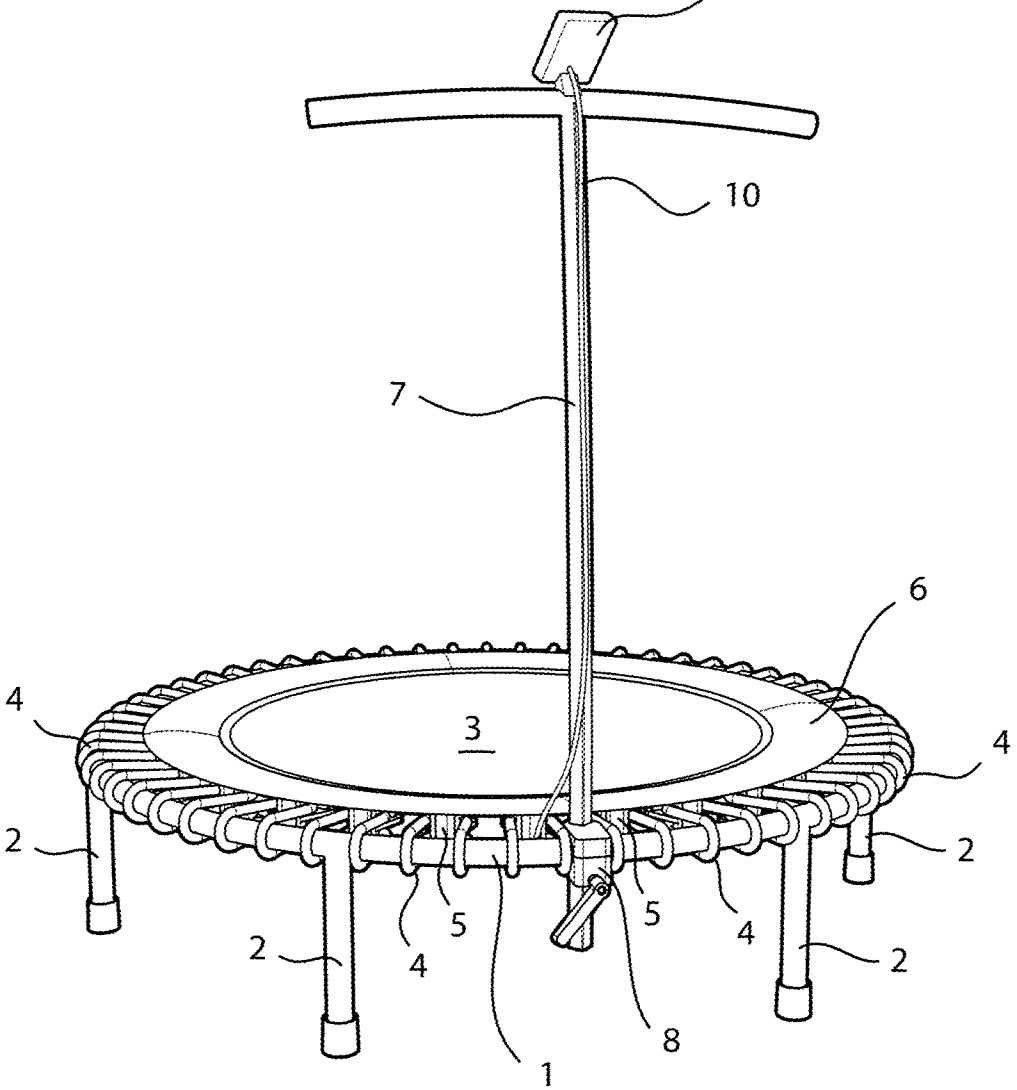
FIG. 1 shows a perspective view of a trampoline according to the invention in a schematic illustration.

FIG. 1 shows a trampoline according to the invention with an encircling frame 1, from which legs 2 emanate, which legs preferably extend vertically when the trampoline is set up. Other legs or leg arrangements are also possible. A jumping mat 3 is stretched in the frame 1 by means of rope rings 4 and is hooked into hooks 5 and wound around the frame 1. The hooks 5 are fastened to the jumping mat 3, e.g. by stitching. A fundamental structure of this kind is known from the prior art. Alternative fastening possibilities are likewise known. For example, the jumping mat 3 can be connected to the frame by means of elastic open rope sections which are likewise hooked into hooks. Suspension by means of spiral springs is also known. The invention is independent of the type of suspension.

The jumping mat 3 is of flexible design. When subject to a load, it is deformed in corresponding fashion. The restoring forces for tensioning the jumping mat 3 are made available essentially by the rope rings 4.

The jumping mat 3 has a border 6, which is of encircling design and preferably extends over the hooks 5. The border 6 is advantageously of cushioned design. Thus, if the user of the trampoline leaves the jumping surface and impinges upon the border 6, the contact (when jumping for example) is cushioned. It is expedient if the border 6 extends outside the jumping region tensioned by the hooks 5.

Reference sign 7 denotes a handlebar, which can be connected to the frame 1 via a receptacle 8. The handlebar 7 makes it easier to perform certain exercises on the trampoline, with the user of the trampoline gripping the handlebar. Arranged at the top of the handlebar 7 is a display 9, via which parameters of the user, e.g. the oscillation amplitude or position of the user, can be read out. For this purpose, the display 9 is connected via a cable 10 to an evaluation unit, which will be described in greater detail below. The display 9 can also be designed as an input unit, via which it is possible to input parameters, e.g. a desired sequence of jumps.

Figure 2:
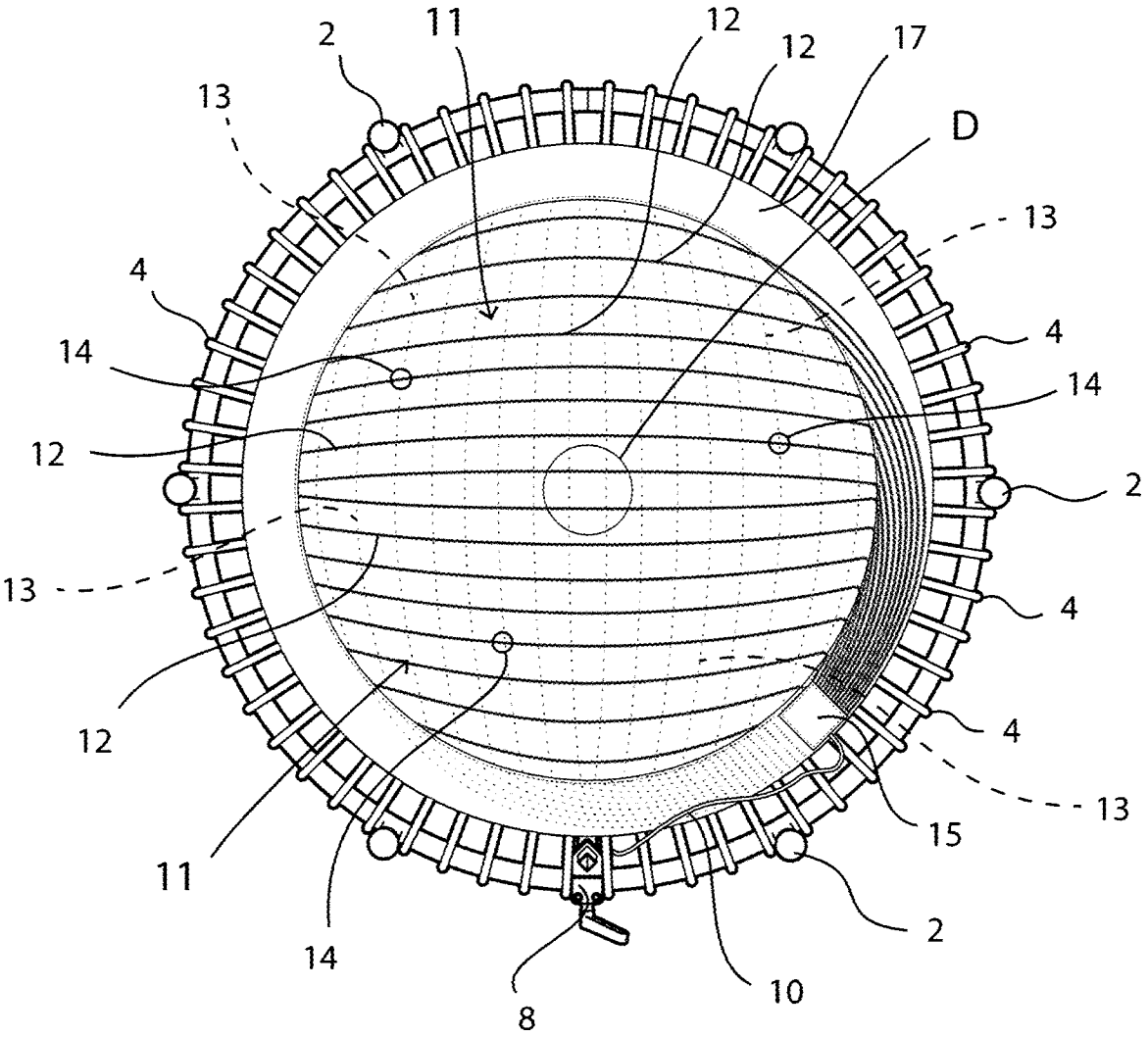
FIG. 2 shows a view of the trampoline according to FIG. 1 from below in a schematic illustration.

FIG. 2 shows a view of the trampoline according to FIG. 1 from below. This view clearly shows a sensor arrangement 11, which is arranged below the jumping mat 3 and is used to acquire information during use of the jumping mat 3. The sensor arrangement 11 is connected to the jumping mat 3, for example. It has proven particularly advantageous if the sensor arrangement 11 is releasably connected to the jumping mat 3. It can then be retrofitted or employed only when required. The sensor arrangement 11 is connected to the jumping mat 3 via a hook and loop connection, for example. Press studs may be considered as an alternative. It is sufficient for functional fastening if the sensor arrangement 11 is connected to the jumping mat 3 only at individual points or regions.

The sensor arrangement 11 has first sensor lines 12 and second sensor lines 13, which form crossing points 14. For reasons of clarity, only a few crossing points 14 are provided with reference signs in FIG. 2.

The sensor lines 12, 13 are connected to an evaluation unit 15 and are each designed as transmitting and receiving lines. It is irrelevant here whether the sensor lines 12 are receiving lines and the sensor lines 13 are transmitting lines or vice versa. It is important that the sensor lines 12 and the sensor lines 13 are electrically insulated from one another in the region of the crossing points 14. In the region of the crossing points 14, the sensor arrangement 11 forms capacitive measuring points which can detect and pinpoint the position of a person.

The insulation can be implemented by individual insulation of the sensor lines 12, 13 in the region of the crossing points 14, for example. Each crossing point 14 is thus insulated individually. In terms of production, it is advantageous to insulate the sensor lines 12, 13 over a larger area, e.g. over a plurality of crossing points 14. In the present case, the insulation is made available by an intermediate layer 16 of the kind explained in greater detail in conjunction with FIG. 3.

The first and the second sensor lines 12, 13 are stitched onto the intermediate layer 16. To ensure that the sensor lines 12, 13 do not touch each other, the first sensor lines 12 are advantageously stitched onto one side and the second sensor line 13 onto the other side of the intermediate layer 16. For this reason, the second sensor lines 13 are illustrated in dashed lines in FIG. 2. They are situated on the other side of the intermediate layer, which advantageously faces the jumping mat 3.

The intermediate layer 16 is preferably connected to the jumping mat 3, being stitched to it, for example. As already mentioned above, it is also possible to provide a releasable connection of the kind described in greater detail in conjunction with FIG. 3.

In the case of a trampoline in the use position, the first sensor lines 12 and the second sensor lines 13 thus run below the jumping mat 3. This protects the sensor lines 12, 13.

In the case of the illustrated advantageous exemplary embodiment of the trampoline according to the invention, the first sensor lines 12 and the second sensor lines 13 are each curved in their main direction of extent. This has the advantage that the sensor lines 12, 13 can also cover the border regions of the jumping mat 3 particularly well. The main direction of extent is the direction in which the respective sensor line principally extends. Lateral deviations, further details of which will be given below, do not affect the main direction of extent.

It is regarded as particularly advantageous that the spacing between adjacent crossing points 14 in the radial direction of the jumping mat 3 is greater on the outside than on the inside. Thus, the measuring density is greater in the center of the jumping mat 3 than on the outside since the contact between the user and the jumping mat typically tends to take place more in the center. In this context, it is regarded as advantageous if the first sensor lines 12 and/or the second sensor lines 13 have a greater curvature radially toward the outside, toward the free end of the jumping mat 3 or the intermediate layer 16, than the respective sensor lines 12, 13 situated more in the center of the jumping mat 3 or intermediate layer 16.

The intermediate layer 16 has a border 17, which is preferably of encircling design. The border 17 is advantageously situated to the outside of the fastening of the intermediate layer 16 to the jumping mat 3. The first sensor lines 12 and the second sensor lines 13 are preferably routed to the evaluation unit 15 in the region of the border 17. In the region of the border 17, the first sensor lines 12 and the second sensor lines 13 expediently run toward one another. This is advantageous in terms of space.

Figure 3:
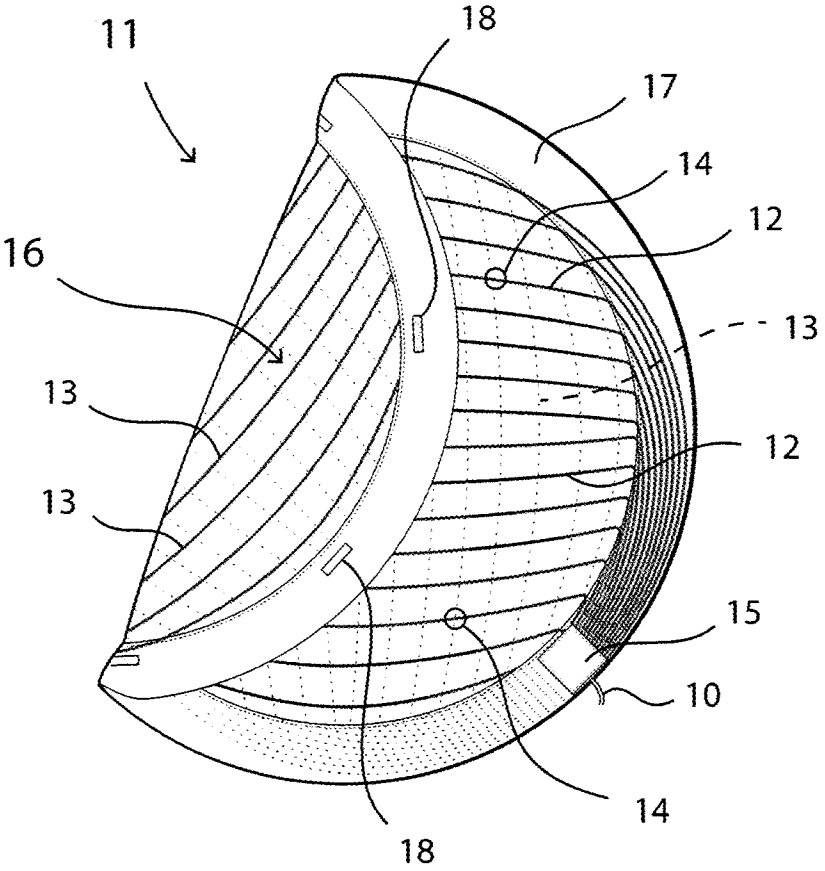
FIG. 3 shows a sensor arrangement according to the invention for the trampoline according to FIG. 1 in isolation in a schematic illustration.

FIG. 3 shows the sensor arrangement 11 in isolation. The intermediate layer 16 is folded over on one side, and therefore the second sensor lines 13, which run on the upper side, are also visible. It has already been observed above that the sensor arrangement 11 can advantageously be connected releasably to the jumping mat 3. This allows retrofitting or else attachment only when required. For this purpose, the intermediate layer 16 has a hook and loop connection 18, which in the present case is of multi-part design. The connection to the jumping mat 3 therefore takes place only at individual locations. In FIG. 3, the hook and loop connection is indicated only by way of example. It may also be arranged radially further in or, for example, have a different shape. Design as an encircling hook and loop connection ring is also possible.

As already stated above, the sensor lines 12, 13 are stitched onto the intermediate layer 16. When the jumping mat 3 is deflected, the intermediate layer 16 likewise undergoes a deflection. The intermediate layer 16 must therefore be extremely flexible and preferably also elastic. In this context, it has proven particularly advantageous if the first sensor lines 12 and the second sensor lines 13 can deviate sideways from their main direction of extent. This enables the intermediate layer 16 to be extended without the risk that the sensor lines 12, 13 will tear.

Figure 4:
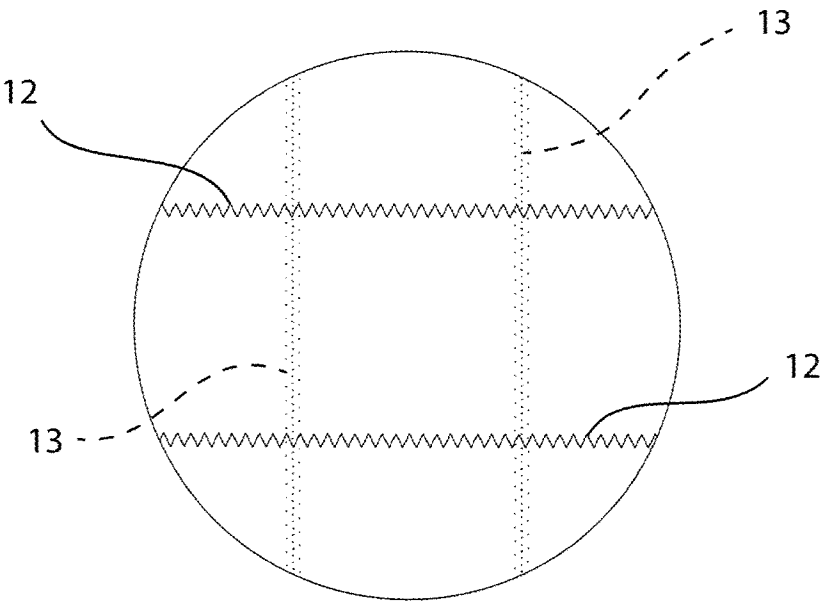
FIG. 4 shows an enlargement of the detail D from FIG. 2 in a schematic illustration.

FIG. 4 shows the detail D from FIG. 2. From this it is clear that the lateral deviations can be implemented in a particularly advantageous way by means of a zigzag stitch. A zigzag stitch of this kind is also advantageous inasmuch as it increases the sensor area.

Figure 5:
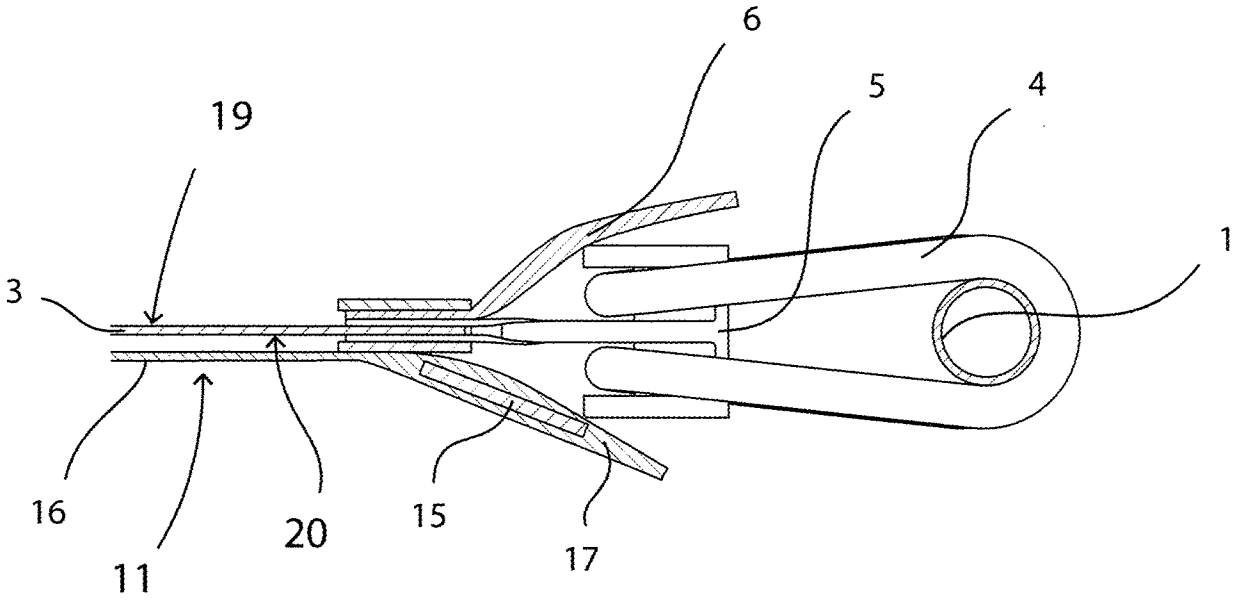
FIG. 5 shows a section through a segment of the trampoline according to FIG. 1 in a schematic illustration.

FIG. 5 shows a section through the border region of the jumping mat 3 and of the sensor arrangement 11 in an abstracted illustration. The jumping mat 3 is stretched within the encircling frame 1 by means of the hooks 5 and of the rope rings 4. The border 6 extends over the hooks 5 and to this extent offers the user protection if he or she does not hit the actual jumping surface. This applies especially if the border 6 is cushioned, as is considered advantageous.

The jumping mat 3 has an upper side 19 and a lower side 20. In the use position of the trampoline, the upper side 19 is on top. The intermediate layer 16 is fastened to the lower side 20 of the jumping mat 3. Like the border 6, the border 17 of the intermediate layer 16 extends below the hooks 5. The border 17 is advantageously likewise cushioned. The evaluation unit 15 is accommodated in the border 17. The cushioning protects the evaluation unit 15 from any impact loading, e.g. in the event of a misstep by the user.

LIST OF REFERENCE SIGNS

1 frame
2 leg
3 jumping mat
4 rope ring
5 hook
6 border
7 handlebar
8 receptacle
9 display
10 cable
11 sensor arrangement
12 first sensor line
13 second sensor line
14 crossing point
15 evaluation unit
16 intermediate layer
17 border
18 hook and loop connection
19 upper side
20 lower side

The invention claimed is:

1. A jumping mat arrangement for a trampoline, comprising:

a jumping mat having an upper side and a lower side; and a sensor arrangement for acquiring information during use of the jumping mat;

wherein:

the sensor arrangement comprises first sensor lines and second sensor lines, wherein the first sensor lines and the second sensor lines form crossing points;

the first sensor lines and the second sensor lines are insulated from one another at least in a region of the crossing points; and a spacing between adjacent crossing points, when viewed in a radial direction of the jumping mat, is greater on an outside of the jumping mat than on an inside of the jumping mat.

2. The jumping mat arrangement as claimed in claim 1, wherein the first sensor lines and the second sensor lines each run in a main direction of extent, and wherein the first and second sensor lines deviate sideways in alternation in the respective main directions of extent.

3. The jumping mat arrangement as claimed in claim 1, wherein the first sensor lines and the second sensor lines run on the lower side of the jumping mat.

4. The jumping mat arrangement as claimed in claim 1, wherein a flexible intermediate layer, which extends over a plurality, in particular over all, of the crossing points, is arranged between the first sensor lines and the second sensor lines.

5. The jumping mat arrangement as claimed in claim 4, wherein the first sensor lines and the second sensor lines are stitched onto the flexible intermediate layer.

6. The jumping mat arrangement as claimed in claim 5, wherein the first sensor lines and the second sensor lines are stitched in a zigzag pattern onto the flexible intermediate layer.

7. The jumping mat arrangement as claimed in claim 4, wherein the first sensor lines are arranged on one side and the second sensor lines on another side of the flexible intermediate layer.

8. The jumping mat arrangement as claimed in claim 4, wherein the flexible intermediate layer is fastened to the jumping mat.

9. The jumping mat arrangement as claimed in claim 4, wherein the flexible intermediate layer is connected to the jumping mat at least in a region of a circumference of the jumping mat.

10. The jumping mat arrangement as claimed in claim 1, wherein the first sensor lines and the second sensor lines are each curved in the respective main directions of extent.

11. The jumping mat arrangement as claimed in claim 1, wherein the first sensor lines and/or the second sensor lines are routed to an evaluation unit along a circumference of the jumping mat arrangement in a border region of the jumping mat arrangement.

12. The jumping mat arrangement as claimed in claim 1, wherein the first sensor lines each form first electrodes, and the second sensor lines each form second electrodes, wherein the first electrodes and the second electrodes are insulated from one another by insulation in the region of the crossing points, and wherein the first electrodes and the second electrodes, together with the insulation, each form a preferably capacitive sensor in the region of the crossing points.

13. A trampoline having a jumping mat arrangement as claimed in claim 1.

* * * * *